US010317043B2

(12) United States Patent
Madril

(10) Patent No.: US 10,317,043 B2
(45) Date of Patent: Jun. 11, 2019

(54) METHOD AND APPARATUS FOR DISTRIBUTING LIGHT

(71) Applicant: JST Performance, LLC, Gilbert, AZ (US)

(72) Inventor: Edgar A. Madril, Mesa, AZ (US)

(73) Assignee: JST Performance, LLC, Gilbert, AZ (US)

( * ) Notice: Subject to any disclaimer, the term of this patent is extended or adjusted under 35 U.S.C. 154(b) by 213 days.

(21) Appl. No.: 15/334,834

(22) Filed: Oct. 26, 2016

(65) Prior Publication Data

US 2017/0114980 A1 Apr. 27, 2017

Related U.S. Application Data

(60) Provisional application No. 62/247,143, filed on Oct. 27, 2015.

(51) Int. Cl.

| | |
|---|---|
| ***F21V 7/06*** | (2006.01) |
| ***F21V 7/04*** | (2006.01) |
| ***F21V 7/00*** | (2006.01) |
| ***F21V 7/09*** | (2006.01) |
| ***F21V 7/22*** | (2018.01) |
| *F21Y 115/10* | (2016.01) |
| *F21Y 113/10* | (2016.01) |

(52) U.S. Cl.

CPC ..... *F21V 7/041* (2013.01); *F21V 7/0083* (2013.01); *F21V 7/09* (2013.01); *F21V 7/22* (2013.01); *F21Y 2113/10* (2016.08); *F21Y 2115/10* (2016.08)

(58) Field of Classification Search

CPC ..... F21V 7/041; F21V 7/0083; F21V 7/09; F21V 7/22

See application file for complete search history.

(56) References Cited

U.S. PATENT DOCUMENTS

| | | | | |
|---|---|---|---|---|
| 4,034,217 | A * | 7/1977 | Dumont | F21V 7/09 362/297 |
| 6,461,023 | B1 * | 10/2002 | McLoughlin | F21S 8/003 362/297 |
| 6,585,397 | B1 * | 7/2003 | Ebiko | F21S 8/00 362/297 |
| 7,040,782 | B2 * | 5/2006 | Mayer | F21V 7/0008 362/297 |
| 7,270,449 | B2 * | 9/2007 | Uke | F21V 7/09 362/297 |
| 9,523,480 | B2 | 12/2016 | Smith | |
| 2004/0114366 | A1 * | 6/2004 | Smith | F21V 7/0008 362/247 |
| 2008/0137345 | A1 * | 6/2008 | Wimberly | F21V 3/04 362/299 |
| 2018/0112849 | A1 * | 4/2018 | Madril | F21V 7/06 |

* cited by examiner

*Primary Examiner* — Anabel Ton

(57) ABSTRACT

A light fixture is provided that includes lighting components having one or more surfaces that subtend light emitted by one or more light sources into one or more corresponding subtended spans. Additional light sources are provided within the light fixture to exhibit back lighting effects that may be seen at various locations external to the light fixture and that may highlight other features of the light fixture intended as aesthetic features. Both the forward projected ray sets and the aesthetic lighting may be controlled independently of each other.

20 Claims, 8 Drawing Sheets

METHOD AND APPARATUS FOR DISTRIBUTING LIGHT

FIELD OF THE INVENTION

The present invention generally relates to lighting systems, and more particularly to a system for distributing light in a specified range.

BACKGROUND

Light emitting diodes (LEDs) have been utilized since about the 1960s. However, for the first few decades of use, the relatively low light output and narrow range of colored illumination limited the LED utilization role to specialized applications (e.g., indicator lamps). As light output improved, LED utilization within other lighting systems, such as within LED "EXIT" signs and LED traffic signals, began to increase. Over the last several years, the white light output capacity of LEDs has more than tripled, thereby allowing the LED to become the lighting solution of choice for a wide range of lighting solutions.

LED lighting solutions have introduced other advantages, such as increased reliability, design flexibility, and safety. For example, traditional turn, tail, and stop signal lighting concepts have been integrated into full combination lamps. Lighting solutions may be designed to optimize light distribution for a number of applications, such as in fair or adverse weather conditions (e.g., dust, fog, rain, and/or snow). For example, a lighting solution may emit light in short or long range, produce a wide or a narrow beam pattern, and/or produce a short or a tall beam pattern.

LED lighting solutions may include LEDs, a printed circuit board (PCB), and associated control circuitry. Various elements of each lighting solution may be selected to optimize travel of light away from the LED (e.g., to produce a particular beam pattern).

Due to the vast amount of variability in selecting elements of a lighting solution, efforts continue to develop particular directional and patterned beams which cater to the specific application for which it was intended.

SUMMARY

In accordance with one embodiment of the invention, a lighting component comprises a reflector having an open rearward end and an open forward end. A light source is configured to pass emitted light through the reflector from the rearward end to the forward end. The reflector includes a first reflective surface extending between the rearward end and the forward end. The first reflective surface is configured to transform a portion of the emitted light into a first subtended span. The reflector includes a second reflective surface extending between the rearward end and the forward end. The second reflective surface is configured to transform a portion of the emitted light into a second subtended span.

In accordance with another embodiment of the invention, a light fixture comprises a PCBA coupled to a housing of the light fixture, and one or more reflectors coupled to the PCBA. Each reflector has an open rearward end and an open forward end. One or more first LEDs are coupled to the PCBA and configured to pass emitted light through respective reflectors from the rearward end to the forward end. Each reflector may include two or more reflective surfaces extending between the rearward end and the forward end.

In accordance with another embodiment of the invention, a method of emitting light from a light fixture comprises emitting light from one or more first LEDs through a rearward end of a reflector. The method further includes subtending at least a portion of the emitted light into a first subtended span with a first reflective surface extending from the rearward end to a forward end of the reflector. The method further includes subtending at least a portion of the emitted light into a second subtended span with a second reflective surface extending from the rearward end to the forward end. The method further includes passing the first and second subtended spans through the forward end of the reflector.

BRIEF DESCRIPTION OF THE DRAWINGS

Various aspects and advantages of the invention will become apparent upon review of the following detailed description and upon reference to the drawings in which.

DETAILED DESCRIPTION

Figure 1:
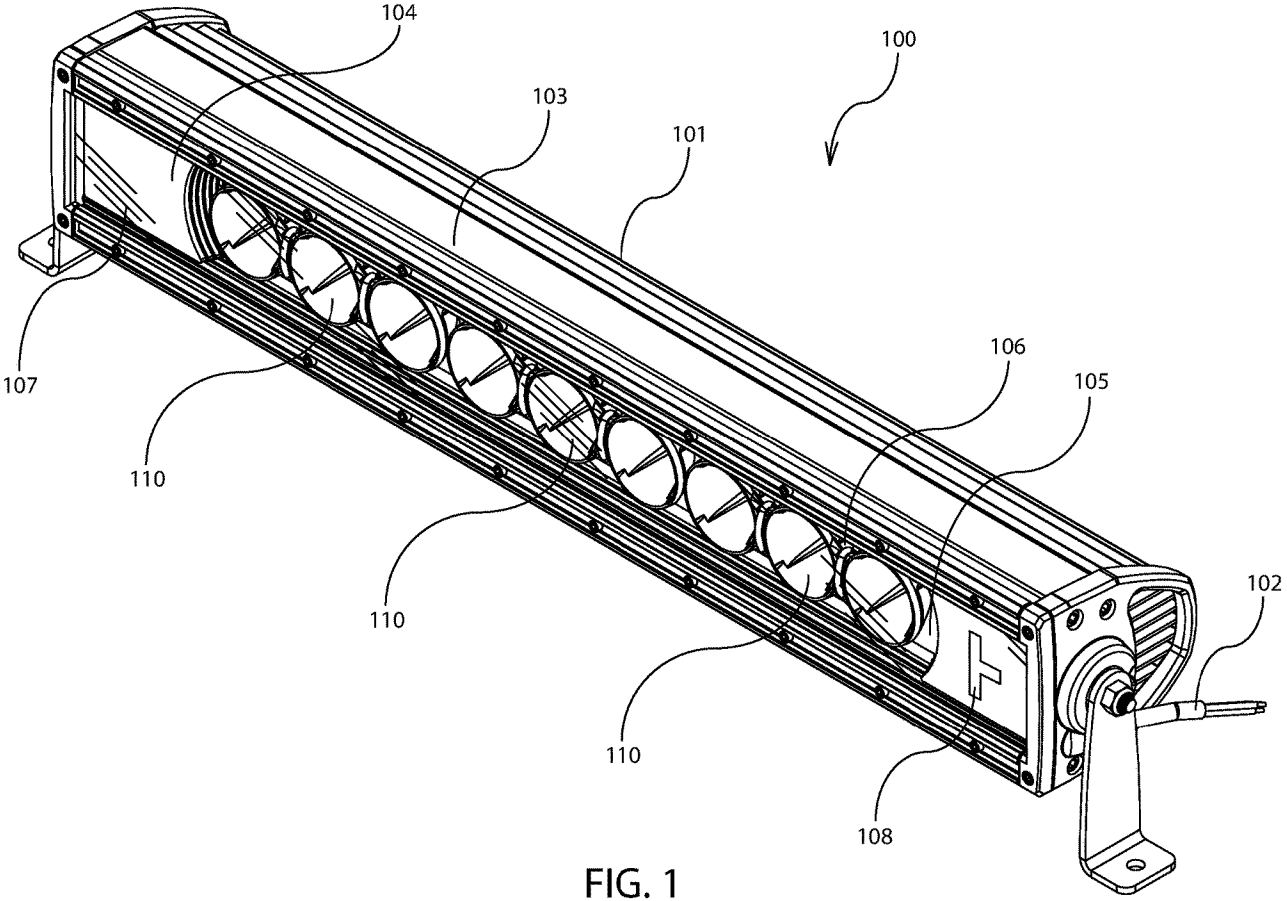
FIG. 1 illustrates one or more lighting components employed within a light fixture, according to an embodiment of the present invention.

Generally, the various embodiments of the present invention are applied to an apparatus for and/or a method of distributing light. Specifically, a lighting component may subtend light from a light source (e.g., a light emitting diode, or LED) by transforming (e.g., reflecting) light received by the lighting component. Subtending may include any transformation of light rays. For example, subtending may include one or more of reflecting light rays and refracting light rays. In another example, subtending may include changing any characteristics of the light rays, including any one or more of amplitude, frequency, and wavelength.

It may be desirable to produce a beam pattern having specific areas of high luminous intensity and/or low luminous intensity light. Accordingly, the lighting component may subtend light so that it falls within a specified range or target luminance. Target luminance may refer to the luminous intensity of light as it passes through a two-dimensional surface in a direction non-parallel to the two-dimensional surface, where the luminous intensity varies per unit of projected area. The lighting component may include one or more reflectors to magnify and/or diversify the target luminance of the lighting component. The lighting component may be coupled to a printed circuit board assembly (PCBA). An LED may be coupled to the PCBA, and may emit light through the lighting component from a rearward end to a forward end.

One or more reflective surfaces may be positioned within the reflector to cause a portion of the emitted light to be subtended into one or more subtended spans. The shapes, dimensions, and/or surface qualities of each reflective surface may be varied to optimize the resulting beam pattern. Further, the size and quantity of reflective surfaces may be varied to optimize the resulting beam pattern. For example, each reflective surface may extend from the rearward end to the forward end, or some distance less. In another example, each reflective surface may have unique and/or different foci. In another example, at least one of the reflective surfaces may be configured to subtend emitted light into a narrow, or collimated beam (e.g., a spot beam), and at least one of the reflective surfaces may be configured to subtend emitted light into a wide, or diffused beam (e.g., a flood beam).

Where the lighting component includes more than one reflector, each reflector may be oriented in a series or an array of reflectors (e.g., side-by-side, or end-to-end, or both). For example, reflectors may appear in a row or column of one, two, three, four, or more reflectors. In another example, reflectors may appear in a row of nine reflectors. In another example, reflectors may appear in an array having two or more rows and two or more columns. In another example, at least one row and/or column in an array of reflectors may be offset from the at least one other row and/or column.

The lighting component may be used in a light fixture. The light fixture may provide power to the PCBA, and the PCBA may provide power to one or more LEDs. In one example, the one or more LEDs may emit light through the one or more reflectors. In another example, one or more LEDs may emit light behind the one or more reflectors (e.g., exterior to an internal cavity of the reflectors). Light emitted external to the one or more reflectors may cause a back-lighting effect within the lighting fixture.

The one or more LEDs emitting light through the one or more reflectors and the one or more LEDs emitting light external to the one or more reflectors may emit white light, visible light of any other wavelength, and/or light from the non-visible spectrum (e.g., infrared light). For example, the light emitted by the one or more LEDs emitting light through the one or more reflectors may be different than the light emitted by the one or more LEDs emitting light external to the one or more reflectors.

FIG. 1 illustrates a light fixture 100 with one or more lighting components 110 configured therein. For example, lighting components 110 may be placed within a housing 103 of light fixture 100 and/or may be secured between a transparent media 107 and one or more PCBAs 105. PCBAs 105 may include one or more first LEDs (e.g., LEDs 550 of FIG. 5A) and one or more second LEDs (e.g., LEDs 570 of FIG. 5A) for emitting light from light fixture 100. The transparent media 107 may enclose lighting components 110, the first and second LEDs, and PCBA 105 within housing 103 (e.g., sealed therein).

For example, emitted light may pass through lighting components 110, one or more panels 104, transparent media 107, and/or through any combination thereof. In another example, each lighting component 110 may be positioned to subtend light from corresponding first LEDs on PCBA 105. In another example, each side panel 104 may be positioned to subtend light from corresponding second LEDs on PCBA 105. In another example, a portion of light emitted by second LEDs may pass through transparent media 107 without interaction with lighting components 110 and/or panels 104 (e.g., through gaps 106 between lighting components 110 and housing 103).

Further, PCBAs 105 may have control circuitry for regulating power to the first and second LEDs. PCBAs 105 may receive power from an external power source (not shown) or may be powered internally (e.g., via a battery, not shown). For example, power may be received from a power cable 102 extending through housing 103. The control circuitry of PCBA 105 may regulate flow of power to the first and second LEDs in order to provide one or more modes of operation. For example, the first and second LEDs may be regulated to emit light in an on mode, an off mode, an intermittent mode (e.g., flashing), and/or in any other mode capable of creating light illumination and/or signaling. In another example, the first LEDs may be operated independently of the second LEDs. In another example, the second LEDs may be operated independently of the first LEDs.

PCBAs 105 may be capable of receiving commands from a user via a user interface (e.g., a switch), to select any one of the modes of operation. For example, in one mode of operation, light may be emitted by the first LEDs (e.g., passing through the lighting components 110). In another example, in one mode of operation, light may be emitted by the second LEDs (e.g., without interaction with lighting components 110 and/or panels 104). In another example, in one mode of operation, light may be emitted by both the first and second LEDs. In another example, in one mode of operation, no light may be emitted.

Housing 103 of light fixture 100 may include heat sink fins 101 for dissipating heat away from first and second LEDs during operation thereof. For example, heat produced by first and second LEDs may be passed through housing 103 into heat sink fins 101 (e.g., via heat conduction). In another example, heat passed into heat sink fins 101 may be passed into an environment (e.g., via convection).

Lighting components 110 may be sized to fit within housing 103, to subtend light emitted by first LEDs into a target luminance (e.g., a spot beam pattern), and/or to optimize the sizing of gaps 106. Thus, light emitted by second LEDs may pass through gaps 106 without being subtended by lighting components 110. Accordingly it may be desirable to optimize both light subtended by lighting components 110 (e.g., light emitted by first LEDs) and to optimize light not subtended by lighting components 110 (e.g., light emitted by second LEDs). For example, subtended light may produce a first target luminance, and non-subtended light may produce a second target luminance less than the first target luminance.

Panels 104 may be configured within housing 103 for creating light illumination and/or signaling. For example, panels 104 may be opaque, translucent, transparent, and/or may include one or more regions of transparency and/or translucence portions 108 to enable passage of light emitted by second LEDs. For example, regions 108 may be in the likeness of graphics to highlight a particular characteristic of light fixture 400 (e.g., branding). In another example, regions 108 may be in the likeness of icons (e.g., hazard indicator icons) to indicate hazard conditions.

First and second LEDs may emit light of any wavelength in the visible spectrum (e.g., red light), and outside the visible spectrum (e.g., infra-red light) to enable more than one luminance and/or signaling option. For example, first LEDs may emit white light. In another example, second LEDs may emit red light.

During operation, a first mode of operation may be selected corresponding to powering of the first LEDs. Thus, during the first mode, the first LEDs may emit light through lighting components 110, and at least a portion of the emitted light may be subtended by one or more lighting components 110. Further, in the first mode, subtended light may pass from light fixture 100 in a first target luminance (e.g., corresponding to a spot beam pattern). The first target luminance may represent a "primary light" mode of light fixture 100 (e.g., to enable the user to see environmental conditions and/or obstructions in non-daylight lighting conditions).

During operation, a second mode of operation may be selected corresponding to powering of the second LEDs. Thus, during the second mode, the second LEDs may emit light through regions 108 of panels 104, or which passes through gaps 106 without being subtended by lighting components 110. Further, in the second mode, light emitted by second LEDs may pass in a second target luminance (e.g., corresponding to a flood beam pattern). The second target luminance may represent a "back-lit" mode of light fixture 100 (e.g., to enable light fixture 100 to be seen in either daylight or non-daylight lighting conditions).

Figure 2:
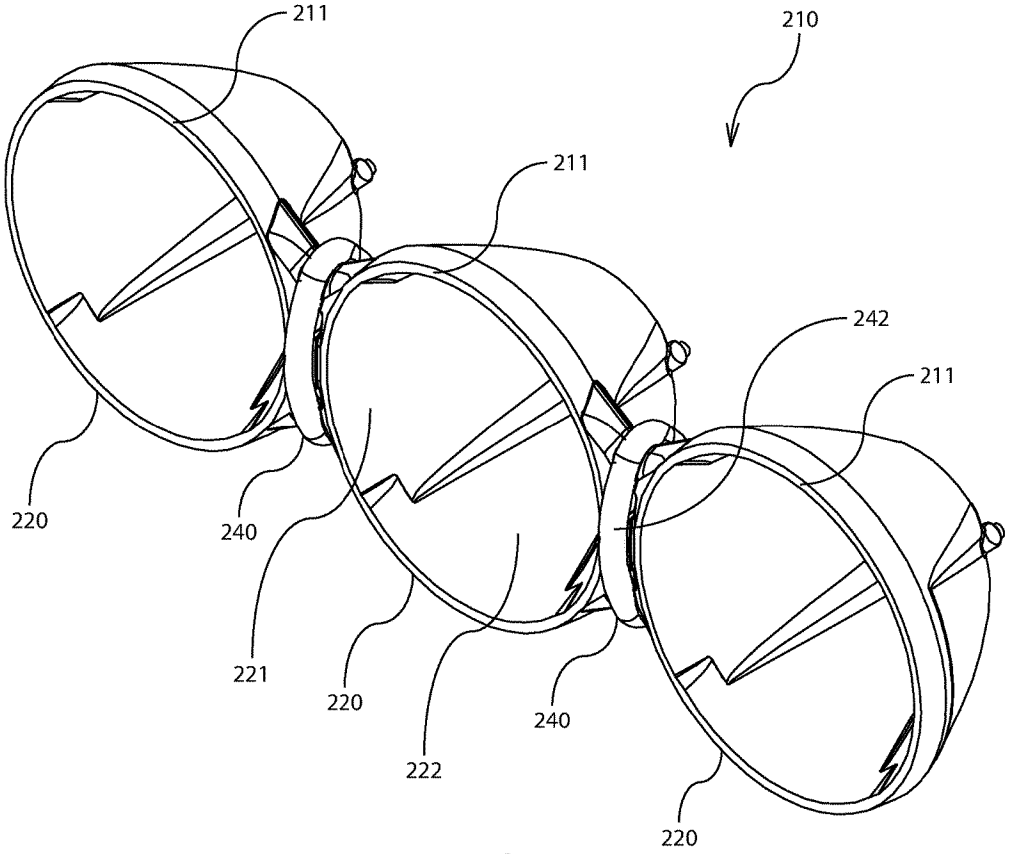
FIG. 2 illustrates an isometric view of one of the lighting components of FIG. 1.

FIG. 2 illustrates an isometric view of a lighting component 210 which may include one or more reflectors 220 (e.g., three reflectors). A person of ordinary skill in the art will appreciate that any number of reflectors 220 may be formed in a single lighting component. As exemplified in FIG. 2, reflectors 220 may be configured in a series orientation. In another example, reflectors 220 may be configured in an array. In another example, reflectors 220 may be removably connected to each other.

Figure 5B:
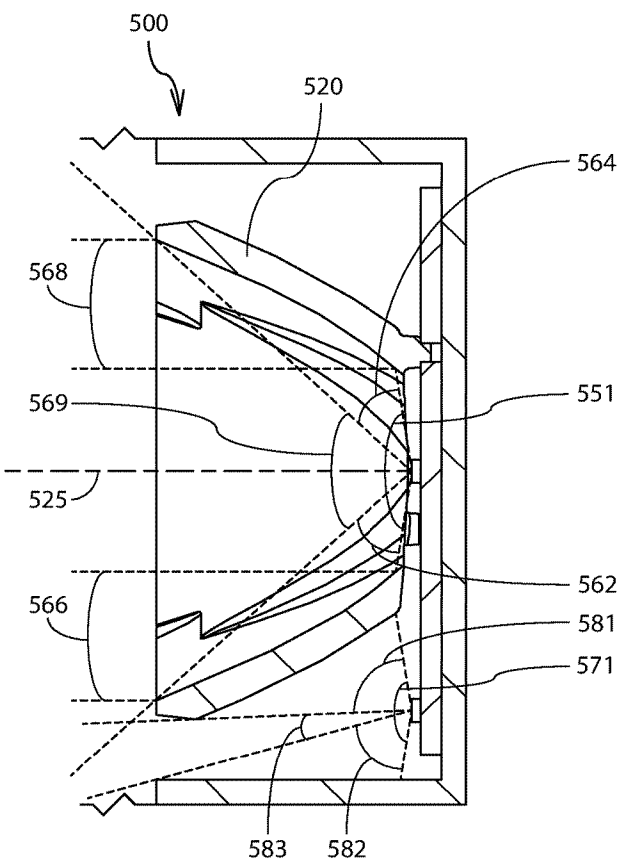
FIG. 5B illustrates a cross-sectional view of the light fixture of FIG. 1.
Figure 5A:
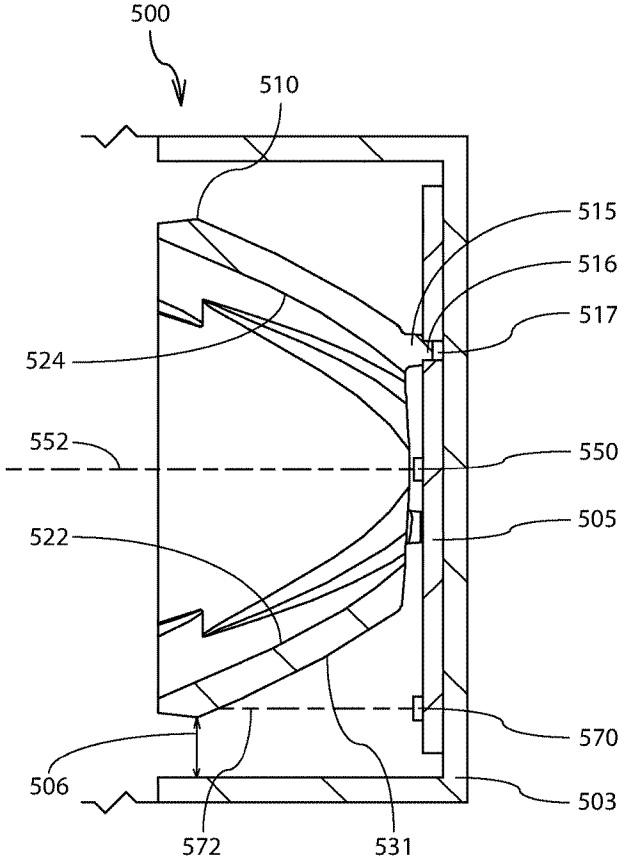
FIG. 5A illustrates a cross-sectional view of the light fixture of FIG. 1.

Each reflector 220 may include one or more reflective surfaces (e.g., first surface 221, second surface 222) for subtending light emitted by corresponding LEDs (e.g., LEDs 550 of FIG. 5A). For example, each reflector 220 may include at least two reflective surfaces. In another example, each reflector 220 may include at least four reflective surfaces.

Each reflective surface may have unique or similar shapes, dimensions and/or surface qualities. For example, first surface 221 may have a first focus, such that emitted light may be subtended by first surface 221 into a first subtended span (e.g., span 665 of FIG. 6B). In another example, second surface 222 may have a second focus different from the first focus, such that emitted light may be subtended by second surface 222 into a second subtended span (e.g., span 566 of FIG. 5B) different from the first subtended span.

One or more bumpers 240 may be configured on each lighting component 210 to facilitate in attachment of lighting component 210 within a housing (e.g., housing 103 of FIG. 1) and/or securement of lighting component 210 between a transparent media and one or more PCBAs (e.g., transparent media 107 and PCBAs 105 of FIG. 1). For example, at least one bumper 240 may extend across a forward portion 211 of lighting component 210 such that bumper 240 may contact the transparent media and/or forward portion 211 may be spaced from the transparent media. In another example, a bumper 240 may extend between each reflector 220 (e.g., a lighting component 210 with three reflectors 220 may have two bumpers 240 as exemplified in FIG. 2). In another example, a lighting component 210 may have at least two bumpers to increase stability of the lighting component 210 when configured within the housing and/or secured between the transparent media and the PCBA.

Each bumper 240 may be formed of elastic material (e.g., rubber) to enable compression and/or deformation of the bumpers 240 when lighting component 210 is configured within the housing and/or secured between the transparent media and the PCBA. For example, the transparent media may exert a force on bumpers 240, such that the force is transferred to lighting component 210 to retain lighting component 210 against the PCBA. In another example, the transparent media may exert a force on bumpers 240 causing bumpers 240 to deform, but where the force in insufficient to cause lighting component 210 to deform. Accordingly, lighting component 210 may be formed of an inelastic material as compared to bumpers 240.

Figure 3:
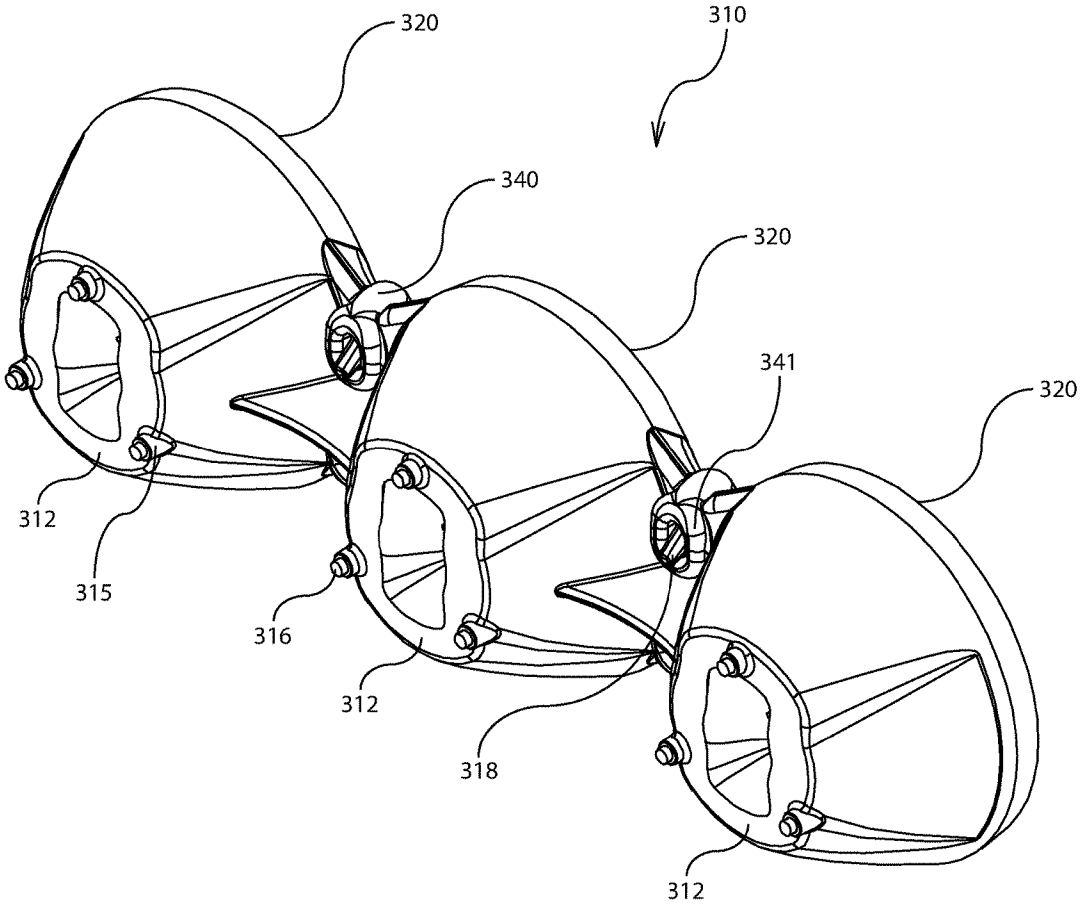
FIG. 3 illustrates an isometric view of one of the lighting components of FIG. 1.

FIG. 3 illustrates an isometric view of a lighting component 310 which may include one or more reflectors 320 (e.g., three reflectors). For example, reflectors 320 may be formed integrally with each other. Each reflector 320 may include a rearward portion 312 with one or more legs 315 configured to contact one or more PCBAs (e.g., PCBAs 105 of FIG. 1). For example, legs 315 may ensure an optimal separation distance between the PCBAs and reflectors 320. In another example, legs 315 may ensure an optimal separation distance between LEDs (e.g., LEDs 650 of FIG. 6A) and reflectors 320. In another example, each rearward portion 312 may include at least three legs 315 to enable a stable engagement between lighting component 310 and the PCBAs.

At least one of the one or more legs 315 may include a feature 316 configured to interconnect with the PCBAs (e.g., with a corresponding feature of the PCBAs). For example, feature 316 may ensure an optimal geometric configuration of lighting component 310 within a housing (e.g., housing 103 of FIG. 1) and/or when secured between a transparent media (e.g., transparent media 107 of FIG. 1) and the PCBAs. In another example, each leg 315 may include a feature 316 configured to interconnect with the PCBAs. In another example, at least three features 316 may extend from each reflector 320 to interconnect with the PCBAs to ensure the optimal geometric configuration. In another example, feature 316 may be in the likeness of a peg, and may interconnect with a corresponding slotted feature of the PCBA.

One or more bumpers 340 may be configured on each lighting component 310 to facilitate in attachment of lighting component 310 within the housing and/or for securement of lighting component 310 between the transparent media and the PCBAs. Each bumper 340 may include opposing ends with connectors 341 for attachment to lighting component 310. For example, connectors 341 of bumper 340 may interconnect with corresponding connectors 318 of lighting component 310. In another example, at least one bumper 340 may extend across a forward portion (e.g., forward portion 211 of FIG. 2) of lighting component 310. In another example, connectors 318 of lighting component 310 may be configured to face oppositely of the forward portion. In another example, each connector 341 may be in the likeness of a loop, and may attach with a corresponding hooked connector 318 of the lighting component 310.

Each bumper 340 may be formed of elastic material (e.g., an elastomer) to enable stretching of the bumper 340 when attached to lighting component 310. For example, a middle portion (e.g., middle portion 242 of FIG. 2) may stretch across the forward portion when connectors 341 at opposing ends are attached to corresponding connectors 318 of lighting component 310. In another example, stretching of the bumper 340 may cause an internal tensile force which facilitates in the attachment of connectors 341 to connectors 318.

Figure 4:
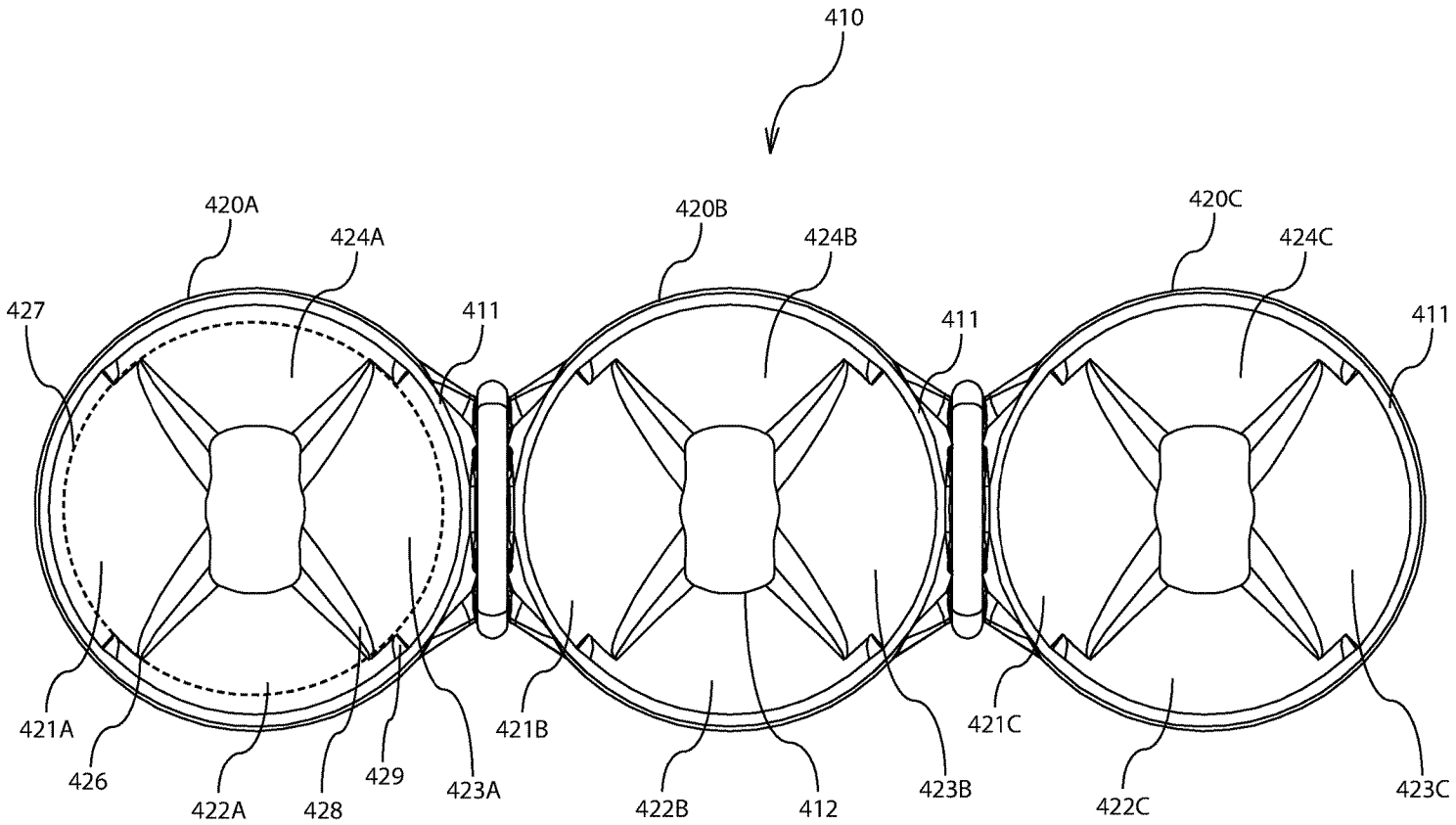
FIG. 4 illustrates a front view of one of the lighting components of FIG. 1.

FIG. 4 illustrates a front view of a lighting component 410 which may include one or more reflectors 420 (e.g., reflectors 420A, 420B, 420C). Each reflector may include one or more reflective surfaces. For example, reflector 420A may include a first surface 421A, a second surface 422A, a third surface 423A, and a fourth surface 424A. In another example, reflector 420B may include a first surface 421B, a second surface 422B, a third surface 423B, and a fourth surface 424B. In another example, reflector 420C may include a first surface 421C, a second surface 422C, a third surface 423C, and a fourth surface 424C. Each reflective surface may extend from a forward portion 411 to a rearward portion 412 of each respective reflector.

Each reflective surface may have unique or similar shapes for optimizing the subtending of light therefrom. For example, reflective surfaces may be flat, concave, and/or convex. In another example, reflective surfaces may be spherical, parabolic, elliptic, or may have other non-uniform curvatures. In another example, first 421A, second 422A, third 423A, and fourth 424A surfaces may be parabolic.

Each reflective surface may have unique or similar dimensions for the optimizing subtending of light therefrom. For example, first surface 421A may have a first focus, such that emitted light may be subtended by first surface 421A into a first subtended span (e.g., span 665 of FIG. 6B). In another example, second surface 422A may have a second focus different from the first focus, such that emitted light may be subtended by second surface 422A into a second subtended span (e.g., span 566 of FIG. 5B) different from the first subtended span. In another example, third surface 423A may have a third focus different from the second focus and similar to the first focus, such that emitted light may be subtended by third surface 423A into a third subtended span (e.g., span 667 of FIG. 6B) different from the second subtended span and similar to the first subtended span. In another example, fourth surface 424A may have a fourth focus different from the first and third foci and similar to the second focus, such that emitted light may be subtended by fourth surface 424A into a fourth subtended span (e.g., span 568 of FIG. 5B) different from the first and third subtended spans and similar to the second subtended span.

Thus, first surface 421A may be similar to third surface 423A. For example, first surface 421A may have a similar focus to third surface 423A. In another example, first surface 421A may be symmetric to third surface 423A about a central axis (e.g., central axis 525 of FIG. 5B) of reflector 420A. In another example, first surface 421A may be configured oppositely of third surface 423A about the central axis. Further, second surface 422A may be similar to fourth surface 424A. For example, second surface 422 A may have a similar focus to fourth surface 424A. In another example, second surface 422A may be symmetric to fourth surface 424A about the central axis of reflector 420A. In another example, second surface 422A may be configured oppositely of fourth surface 424A about the central axis. Alternatively, first surface 421A may be different from third surface 423A (e.g., having different foci) and/or second surface 422A may be different from fourth surface 424A (e.g., having different foci).

Each reflective surface may have unique or similar surface qualities for optimizing the subtending of light therefrom. For example, reflective surfaces may be smooth, contoured, and/or rough. In another example, reflective surfaces may have high reflectivity (e.g., about 1), and/or some reflectivity less than the high reflectivity (e.g., about 0.5). Thus, some or all of the reflective surfaces may have the high reflectivity and/or some or all of the reflective surfaces may have some reflectivity less than the high reflectivity. In another example, first 421A, second 422A, third 423A, and fourth 424A surfaces may be smooth and may have the high reflectivity.

The shapes, dimensions, and/or surface qualities of reflectors 420B and 420C may be unique and/or similar to the shapes, dimensions, and/or surface qualities discussed above with reference to reflector 420A. For example, each of first surfaces 421A, 421B, and 421C may have unique and/or similar shapes, dimensions, and/or surface qualities. A person of ordinary skill in the art will appreciate that various combinations of shapes, dimensions, and/or surface qualities may be employed to produce an assortment of subtended spans of light.

Furthermore, each reflective surface of reflector 420A may occupy a portion of reflector 420A (e.g., configured within a discrete position) to further optimize the subtending of light therefrom. As exemplified in FIG. 4, first surface 421A may resemble a left side portion, second surface 422A may resemble a bottom side portion, third surface 423A may resemble a right side portion, and fourth surface 424A may resemble a top side portion of reflector 420A. In another example, each reflective surface may occupy approximately equal portions of reflector 420A, such that in a reflector having four reflective surfaces, each reflective surface may occupy about 25 percent of an inner surface area of the reflector. In another example, each reflective surface may occupy less and/or greater than equal portions (e.g., a 20/30/20/30 percent split of the inner surface area). In another example, the configuration of reflective surfaces of reflectors 420B and 420C may be unique and/or similar to that of reflector 420A.

Each reflective surface may have a perimeter which contacts forward portion 411, rearward portion 412 and abutting reflective surfaces on opposing edges thereof. A difference in shape, dimension, and/or surface quality of abutting reflective surfaces may cause a nonalignment of corresponding edges (e.g., an edge of first surface 421A may imperfectly abut an edge of second surface 422A due to differences in foci).

Accordingly, a surface effect may be configured to create a transition between unaligned edges (e.g., surface effects 428, 429). For example, a single surface effect between abutting edges may extend entirely from forward portion 411 to rearward portion 412 (e.g., where a point of abutment lies outside of the range between forward portion 411 and rearward portion 412). In another example, a first surface effect 428 may extend from forward portion 411 toward rearward portion 412 and a second surface effect 429 may extend from rearward portion 412 toward forward portion 411, such that the first and second surface effects terminate at an abutment point 426 some distance between the forward and rearward portions 411, 412. Thus, abutment point 426 may represent a position at which abutting edges of corresponding reflective surfaces are equal in distance from the central axis of each reflector. In another example, first and second surface effects may terminate along an abutment line 427, such that first surface effect 428 may be offset from second surface effect 429 (e.g., as exemplified in FIG. 4). Thus, the greater the offset between first and second surface effects 428, 429, the larger the overlap of corresponding reflective surfaces.

FIG. 4 exemplifies a configuration wherein abutment point 426 and/or abutment line 427 is substantially closer to forward portion 411 than to rearward portion 412, such that forward portion 411 is substantially circular in shape whereas rearward portion 412 is substantially non-circular in shape. Nevertheless, a person of ordinary skill in the art will appreciate that abutment point 426 and/or abutment line 427 may be configured to be any distance between forward and rearward portions 411, 412, at forward or rearward portions 411, 412, and/or beyond forward or rearward portions 411, 412, depending on the shapes, dimensions, and/or surface qualities of each reflective surface.

While FIG. 4 exemplifies reflectors with four reflective surfaces, a person of ordinary skill in the art will appreciate that each reflector may have more or less reflective surfaces (e.g., 2, 3, 4, 5, 6, or more reflective surfaces). Further, each reflector may include unique and/or similar quantities of reflective surfaces.

FIGS. 5A and 5B illustrate a cross-sectional view of a light fixture 500 with a component 510 and PCBA 505 enclosed within a housing 503. Component 510 may include a single reflector 520. Nevertheless, a person of ordinary skill in the art will appreciate that the principles discussed herein may apply to lighting components having a greater number of reflectors (e.g., 2, 3, 4, 5, 6, or more). Lighting component 510 may be spaced an optimal separation distance from PCBA 505 and/or a first LED 550 by one or more legs 515. Further, lighting component 510 may be secured in an optimal geometric configuration with PCBA 505 by one or more features 516 extending from the one or more legs 515 for interconnection with one or more corresponding features 517 of PCBA 505.

The optimal separation distance and optimal geometric configuration may ensure that light emitted by first LED 550 and/or an effective span 551 of light emitted by first LED 550 is directed through reflector 520 (e.g., during a "primary light" mode of operation). Alternatively, light emitted by second LED 570 may not be directed through reflector 520. First LED 550 may be configured on PCBA 505 such that an axis of symmetry 552 of effective span 551 extends substantially through reflector 520. For example, axis of symmetry 552 may be perpendicular to a surface of PCBA 505. In another example, axis of symmetry 552 may be collinear with a central axis 525 of reflector 520 (e.g., central axis 525 may be an axis of symmetry of reflector 520).

Reflector 520 may include at least a lower surface 522 and an upper surface 524 for subtending light. Lower and upper surfaces 522, 524 may be unique and/or similar in shape, dimension, and/or surface quality. For example, where lower and upper surfaces 522, 524 are similar, each surface may share a common focus and/or a focus of lower surface 522 may be equal to a focus of upper surface 524. In another example, where lower and upper surfaces 522, 524 are similar, each surface may be symmetrically spaced from and/or located oppositely of central axis 525 (e.g., and axis of symmetry 552 of LED 550). In another example, lower and upper surfaces 522, 524 may be parabolic.

For illustrative purposes, effective span 551 may be described in terms of one or more portions (e.g., portions 562, 564, 569) of light as each portion passes through reflector 520. For example, a portion 562 may be emitted by LED 550 and may pass toward lower surface 522. Portion 562 may contact lower surface 522 and/or may be subtended (e.g. reflected) by lower surface 522. Thus, portion 562 may be transformed into subtended span 566. In another example, a portion 564 may be emitted by LED 550 and may pass toward upper surface 524. Portion 564 may contact upper surface 524 and/or may be subtended (e.g. reflected) by upper surface 524. Thus, portion 564 may be transformed into subtended span 568. In another example, a portion 569 may be emitted by LED 550 and may pass through reflector 520 without contacting and/or being subtended by either lower or upper surfaces 522, 524. Thus, portion 569 may not be transformed.

The shapes, dimensions, and/or surface qualities of reflector 520 may determine how much of effective span 551 falls into portions 562, 564, and 569. For example, a relatively large dimension of reflector 520 along central axis 525 may result in a higher luminous intensity of emitted light falling within portions 562 and 564, whereas a relatively small dimension along central axis 525 may result in higher luminous intensity of emitted light falling within portion 569. In another example, a relatively large dimension of reflector 520 along an axis perpendicular to central axis 525 may result in higher luminous intensity of emitted light falling within portion 569, whereas a relatively small dimension along an axis perpendicular to central axis 525 may result in higher luminous intensity of emitted light falling within portions 562 and 564. In another example, altering the foci of the lower and upper surfaces 522, 524 may change the amount of emitted light falling within portions 562, 564, and 569. Thus, the shapes, dimensions, and/or surface qualities of reflector 520 may be optimized to produce a target luminance of subtended light (e.g., by subtended spans 566, 568), and/or to produce a target luminance of non-subtended light (e.g., by portion 569).

The target luminance of subtended light and the target luminance of non-subtended light may combine to form a target luminance of the system (e.g., during a first mode of operation of the system). For example, the system may include a lighting component with a single reflector (e.g., as exemplified in FIG. 5B). In another example, the system may include a lighting component with more than one reflector (e.g., three reflectors, as exemplified in FIG. 4). In another example, the system may include more than one lighting component (e.g., three lighting components, each having three reflectors, as exemplified in FIG. 1).

Furthermore, the shapes, dimensions, and/or surface qualities of lower and upper surfaces 522, 524 may influence the directionality of subtended spans 566 and 568. For example, subtended span 566 may pass from reflector 520 as collimated light. In another example, subtended span 568 may pass from reflector 520 as focused light. In another example, subtended span 568 may pass from reflector 520 as diffused light. In another example, subtended spans 566, 568 may pass from reflector 520 with a similar directionality (e.g., both collimated, both focused, or both diffused).

Second LED 570 may be positioned on PCBA 505 so that an effective span 571 of light emitted thereby does not pass through reflector 520 (e.g., during a second mode of operation). For example, second LED 570 may be configured on PCBA 505 such that an axis of symmetry 572 of effective span 571 extends substantially perpendicular to a surface of PCBA 505 (e.g., parallel to axis of symmetry 552). In another example, axis of symmetry 572 may intersect an exterior surface 531 of reflector 520. In another example, axis of symmetry 572 may pass beyond reflector 520 without intersection (e.g., through gap 506).

Effective span 571 may interact with one or more of exterior surface 531 of reflector 520, a surface of PCBA 505, and/or an interior surface of housing 503 in order to illuminate one or more of these surfaces with emitted light (e.g., during a "back-lit" mode of operation). For example, a portion 581 of effective span 571 may be absorbed by exterior surface 531, may cause exterior surface 531 to be illuminated, and/or may be subtended (e.g., reflected) by exterior surface 531 toward the surface of PCBA 505, the interior surface of housing 503, and/or through gap 506. In another example, a portion 582 of effective span 571 may be absorbed by the interior surface of housing 503, may cause the interior surface of housing 503 to be illuminated, and/or may be subtended (e.g., reflected) by the interior surface of housing 503 toward exterior surface 531, the surface of PCBA 505, and/or through gap 506. In another example, a portion 583 of effective span 571 may pass through gap 506 without interaction with exterior surface 531, the interior surface of housing 503, or the surface of PCBA 505.

Thus, the interior of housing 503 may be illuminated by light emitted by second LED 570 to produce a lighting effect (e.g., backlighting during the "back-lit" mode of operation) within housing 503, whereas environmental conditions outside of housing 503 may be illuminated by light emitted by first LED 550. For example, first LED 550 may illuminate environmental conditions forward of light fixture 500 (e.g., in the direction indicated by axis of symmetry 552). In another example, second LED 570 may illuminate the interior of housing 503, which may be viewable from a position forward of light fixture 500 (e.g., when viewing light fixture 500 from a direction opposite of the direction indicated by axis of symmetry 552).

First LED 550 and second LED 570 may emit light in the visible spectrum such that the primary light and back-lit modes of operation are visible to any human eye. For example, light may be emitted having a wavelength of between about 400 nanometers and about 760 nanometers individually or collectively. In another example, first LED 550 may emit white light and second LED 570 may emit colored light. In another example, first LED 550 and second LED 570 may be capable of varying the wavelength of light output (e.g., an RGB LED). Further, first LED 550 and second LED 570 may emit radiation in the non-visible spectrum so that one or more modes of operation are not visible to any human eye, but may be viewable by animals and/or with visibility enhancement systems (e.g., night vision). For example, infrared light may be emitted (e.g., with a wavelength between about 760 nanometers and about 1,000,000 nanometers). In another example, ultraviolet light may be emitted (e.g., with a wavelength between about 100 nanometers and about 400 nanometers).

While LED 550 and LED 570 have been described as singular LEDs, a person of ordinary skill in the art will appreciate that additional first LEDs and additional second LEDs may be incorporated into the present invention in order to increase light output within housing 503, outside of housing 503, or both. Further, it is understood that PCBA 505 may incorporate control circuitry for regulating power provided to the first LEDs and/or second LEDs in accordance with one or more modes of operation (e.g., as discussed with reference to FIG. 1).

Figure 6B:
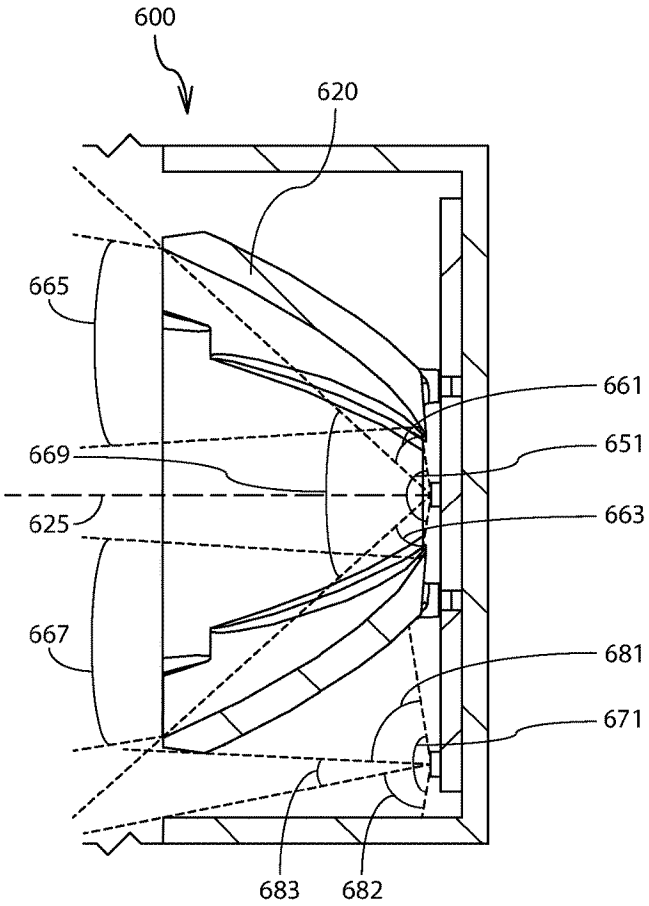
FIG. 6B illustrates a cross-sectional view of the light fixture of FIG. 1.
Figure 6A:
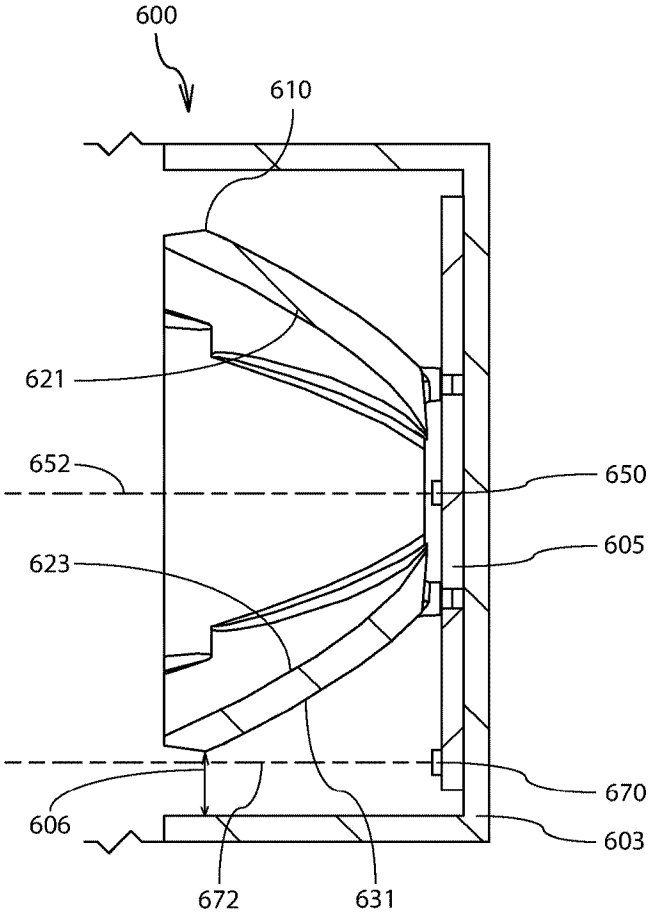
FIG. 6A illustrates a cross-sectional view of the light fixture of FIG. 1.

FIGS. 6A and 6B illustrate a cross-sectional view of a light fixture 600 with a component 610 and PCBA 605 enclosed within a housing 603. Component 610 may include at least one reflector 620 for subtending light emitted by a first LED 650. For example, first LED 650 may be configured on PCBA 605 to emit light and/or to emit an effective span 651 of light through reflector 620 (e.g., during a "primary light" mode of operation). In another example, second LED 670 may be configured on PCBA 605 to emit light and/or emit an effective span 671 of light not passing through reflector 620 (e.g., during a "back-lit" mode of operation). Effective span 651 may have an axis of symmetry 652 extending substantially through reflector 620, whereas effective span 671 may have an axis of symmetry 672 not passing through reflector 620 (e.g., intersecting an exterior surface 631 of reflector 620 or passing beyond reflector 620 through gap 606).

Reflector 620 may include at least a left surface 621 and a right surface 623 for subtending light. Left and right surfaces 621, 623 may be unique and/or similar in shape, dimension, and/or surface quality. For example, where left and right surfaces 621, 623 are similar, each surface may share a common focus and/or a focus of left surface 621 may be equal to a focus of right surface 623. In another example, where left and right surfaces 621, 623 are similar, each surface may be symmetrically spaced from and/or located oppositely of a central axis 625 of reflector 620 (e.g., and axis of symmetry 652 of LED 650). In another example, left and right surfaces 621, 623 may be parabolic.

For illustrative purposes, effective span 651 may be described in terms of one or more portions (e.g., portions 661, 663, 669) of light as each portion passes through reflector 620. For example, a portion 661 may be emitted by LED 650 and may pass toward left surface 621. Portion 661 may contact left surface 621 and/or may be subtended (e.g. reflected) by left surface 621. Thus, portion 661 may be transformed into subtended span 665. In another example, a portion 663 may be emitted by LED 650 and may pass toward right surface 623. Portion 663 may contact right surface 623 and/or may be subtended (e.g. reflected) by right surface 623. Thus, portion 663 may be transformed into subtended span 667. In another example, a portion 669 may be emitted by LED 650 and may pass through reflector 620 without contacting and/or being subtended by either lo left or right surfaces 621, 623. Thus, portion 669 may not be transformed.

The shapes, dimensions, and/or surface qualities of reflector 620 may determine how much of effective span 651 falls into portions 661, 663, and 669. For example, a relatively large dimension of reflector 620 along central axis 625 may result in higher luminous intensity of emitted light falling within portions 661 and 663, whereas a relatively small dimension along central axis 625 may result in higher luminous intensity of emitted light falling within portion 669. In another example, a relatively large dimension of reflector 620 along an axis perpendicular to central axis 625 may result in higher luminous intensity of emitted light falling within portion 669, whereas a relatively small dimension along an axis perpendicular to central axis 625 may result in higher luminous intensity of emitted light falling within portions 661 and 663. In another example, altering the foci of the left and right surfaces 621, 623 may change the amount of emitted light falling within portions 661, 663, and 669. Thus, the shapes, dimensions, and/or surface qualities of reflector 620 may be optimized to produce a target luminance of subtended light (e.g., by subtended spans 665, 667), and/or to produce a target luminance of non-subtended light (e.g., by portion 669). Thus, the target luminance of subtended light and the target luminance of non-subtended light may combine to form a target luminance of the system (e.g., during a first mode of operation of the system).

Furthermore, the shapes, dimensions, and/or surface qualities of left and right surfaces 621, 623 may influence the directionality of subtended spans 665 and 667. For example, subtended span 665 may pass from reflector 620 as collimated light, focused light, or diffused light. In another example, subtended span 667 may pass from reflector 620 as collimated light, focused light, or diffused light. In another example, subtended spans 665, 667 may pass from reflector 520 with a similar directionality.

Effective span 671 may interact with one or more of exterior surface 631 of reflector 620, a surface of PCBA 605, and/or an interior surface of housing 603 in order to illuminate one or more of these surfaces. For example, a portion 681 of effective span 671 may be absorbed by exterior surface 631, may cause exterior surface 631 to be illuminated, and/or may be subtended (e.g., reflected) by exterior surface 631. In another example, a portion 682 of effective span 671 may be absorbed by the interior surface of housing 603, may cause the interior surface of housing 603 to be illuminated, and/or may be subtended (e.g., reflected) by the interior surface of housing 603. In another example, light subtended by one or both of exterior surface 631 and/or the interior surface of housing 603 may pass outward through gap 606, onto each other, and/or toward a surface of PCBA 605. In another example, a portion 683 of effective span 671 may pass through gap 606 without interaction with exterior surface 631, the interior surface of housing 603, or the surface of PCBA 605.

Thus, any surface within housing 603 may be illuminated by light emitted by second LED 670 to produce a lighting effect within housing 603. Nevertheless, left and right surfaces 621, 623 may not be illuminated by light emitted by second LED 670. For example, first LED 650 may illuminate environmental conditions forward of light fixture 600 (e.g., in the direction indicated by axis of symmetry 652). In another example, second LED 670 may illuminate the interior of housing 603, which may be viewable from a position forward of light fixture 600 (e.g., when viewing light fixture 600 from a direction opposite of the direction indicated by axis of symmetry 652). In another example, first and second LEDs 650, 670 may emit light simultaneously and/or intermittently to enable any of the above viewing options.

While LED 650 and LED 670 have been described as singular LEDs, a person of ordinary skill in the art will appreciate that additional first LEDs and additional second LEDs may be incorporated into the present invention in order to increase light output within housing 603, outside of housing 603, or both. Further, it is understood that PCBA 605 may incorporate control circuitry for regulating power provided to the first LEDs and/or second LEDs in accordance with one or more modes of operation (e.g., as discussed with reference to FIG. 1).

Figure 7:
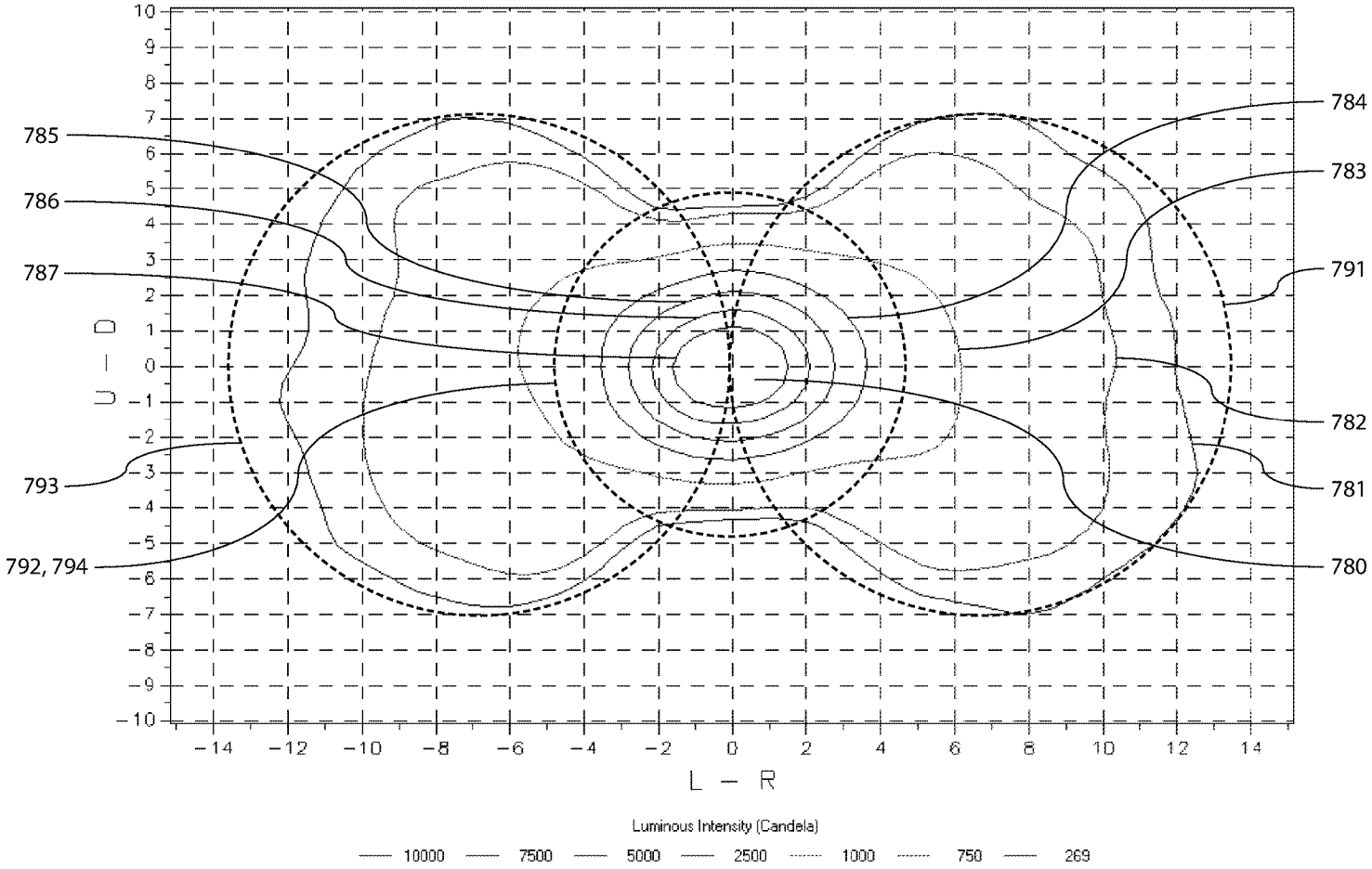
FIG. 7 illustrates an isocandela diagram of a target luminance of light emitted by one of the lighting components of FIG. 1.

FIG. 7 illustrates an isocandela diagram of a target luminance (e.g., beam pattern 780) of light emitted by an LED (e.g., LED 550 of FIG. 5A) and subtended by a lighting component (e.g., lighting component 510 of FIG. 5A). In general, isocandela plots illustrate the luminous intensity of a light source, or, as in this case, the luminous intensity of beam pattern 780. As exemplified in the isocandela diagram of FIG. 7, beam pattern 780 may extend along a width-wise axis (e.g., L-R axis) and along a height-wise axis (e.g., U-D axis), such that the target luminance of emitted light passes through the plane formed by these axes. Furthermore, the incremental values extending along each axis approximately represent angles from an axis of symmetry (e.g., axis of symmetry 552 of FIG. 5A) of the light emitting LED. For example, the axis of symmetry may pass through the plane formed by the L-R & U-D axes at the zero values along these axes (e.g., 0,0). In another example, the axis of symmetry may be perpendicular to the plane formed by the L-R & U-D axes.

Light forming beam pattern 780 may be optimized to pass within one or more luminous regions (e.g., regions 791-794) by altering the shape, dimension, and/or surface quality of reflective surfaces of the lighting component (e.g., lower and upper surfaces 522, 524 and/or left and right 621, 623). For example, a first reflective surface (e.g., left surface 621) may be configured to subtend (e.g., focus) light into one of the luminous regions (e.g., region 791). In another example, a second reflective surface (e.g., lower surface 522) may be configured to subtend (e.g., collimate) light into one of the luminous regions (e.g., region 792). In another example, a third reflective surface (e.g., right surface 623) may be configured to subtend (e.g., focus) light into one of the luminous regions (e.g., region 793). In another example, a fourth reflective surface (e.g., upper surface 524) may be configured to subtend (e.g., collimate) light into one of the luminous regions (e.g., region 794).

A person of ordinary skill in the art will appreciate that the shape, dimension, and/or surface quality of each reflective surface may be varied to produce any configuration of luminous regions. For example, light subtended by two or more reflective surfaces may fall entirely within a single luminous region (e.g., two overlapping regions) to increase luminous intensity within that region (e.g., second and fourth reflective surfaces may subtend light within regions 792, 794, which entirely overlap). In another example, light subtended by two or more reflective surfaces may fall into two partially overlapping luminous regions to increase luminous intensity over a portion of each region (e.g., first and second reflective surfaces may subtend light into partially overlapping regions 792, 791, respectively). In another example, light subtended by two or more reflective surfaces may fall into two non-overlapping luminous regions to increase the span of subtended light into a wider spectrum (e.g., first and third reflective surfaces may subtend light into non-overlapping regions 791, 793).

Further, luminous regions may be similar and/or different in size, where smaller luminous regions may represent regions of higher luminous intensity and larger luminous regions may represent regions of lower luminous intensity (e.g., regions 792, 794 are exemplified as having a first size with relatively higher luminous intensity, while regions 791, 793 are exemplified as having a second size with relatively smaller luminous intensity). Nevertheless, differences in luminous intensity may also vary based on a proportionality of a surface area of each reflective surface. Thus, it may be advantageous to configure each reflective surface with unique and/or similar shapes, dimensions, and/or surface qualities.

In addition, a person of ordinary skill in the art will appreciate that the quantity of reflective surfaces included within the lighting component may be varied to produce any number of luminous regions. For example, a lighting component may include four reflective surfaces (e.g., lighting component 410 with reflective surfaces 421A-424A) which may produce between 1 common luminous region and 4 independent luminous regions. Thus, it may be advantageous to configure a lighting component with greater or fewer reflective surfaces.

Further, a person of ordinary skill in the art will appreciate that the lighting component may include one or more reflectors, where each reflector may include unique and/or similar sets of reflective surfaces to magnify and/or diversify the target luminance of the lighting component. For example, a lighting component may include three reflectors (e.g., lighting component 410 with reflectors 420A-420C) which each reflector having one or more reflective surfaces. Thus, it may be advantageous to configure the lighting component with greater or fewer reflectors.

Each reflective surface may subtend light into at least one of the luminous regions (e.g., regions 791-794). Nevertheless, the luminous intensity of light subtended by each reflective surface may vary across each corresponding luminous region. For example, where luminous regions are separated, each luminous region may have a low intensity perimeter surrounding a high intensity spot which may be centered and/or offset within the low intensity perimeter. In another example, where luminous regions are overlapping (e.g., regions 791-794), each luminous region may have a low intensity perimeter surrounding a high intensity spot, but the overlapping nature of the luminous regions may produce a combined beam pattern (e.g., beam pattern 780). Thus, the luminous regions of the combined beam pattern may be indistinguishable. Further, the luminous regions of the combined beam pattern may form a target luminance of the lighting component (e.g., lighting component 510 of FIG. 5A).

The target luminance may by described in terms of a series of loops (e.g., bands 781-787) which indicate an intensity of beam pattern 780 along each respective loop. For example, a first band 781 may represent a first luminous intensity (e.g., about 269 candela), and may represent a boundary between luminous intensities below and above the first luminous intensity. In this example, points along the L-R and U-D axes and outside band 781 may be less than the first luminous intensity, and points along the L-R and U-D axes and inside band 781 may be greater than the first luminous intensity.

In another example, a second band 782 may represent a second luminous intensity (e.g., about 750 candela). In this example, points along the L-R and U-D axes and outside band 782 may be less than the second luminous intensity, and points along the L-R and U-D axes and inside band 782 may be greater than the second luminous intensity. For example, band 782 may lie interior to and/or may be entirely enclosed by band 781 (e.g., such that band 782 represents a higher luminous intensity than band 781). One or more additional bands may lie interior to band 782 (e.g., bands 783, 784, 785, 786, 787), and each subsequently interior band may represent an incrementally higher luminous intensity (e.g., 1000, 2500, 5000, 7500, 10000).

Thus, regions 791-793 may combine to form beam pattern 780 as represented by bands 781-787. Regions 792, 794 may include high luminous intensity light. This may be, in part, due to substantially all the light subtended by second and fourth reflective surfaces (e.g., lower and upper surfaces 522, 524), due to portions of the light subtended by first and third reflective surfaces (e.g., left and right surfaces 621, 623), and/or due to overlapping portions of regions 791, 793. Alternatively, regions 791, 793 may include high luminous intensity light insofar as they overlap with region 791, and low luminous intensity light in the remaining portions. This distribution of luminous intensity may be exemplified by bands 781-787.

Beam pattern 780 may have roughly a bowtie appearance as exemplified in FIG. 7. However, this appearance may be the result of the shape, dimension, and/or surface quality of the reflective surfaces which form regions 791-794. A person of ordinary skill in the art will appreciate that the appearance of beam pattern 780 may vary in accordance with the principles discussed above. For example, while beam pattern 780 appears substantially symmetric about zero lines of the L-R and U-D axes, asymmetry may also be possible (e.g., by varying the shape, dimension, and/or surface quality of one or more reflective surfaces).

Thus, beam pattern 780, as exemplified in FIG. 7, may be particularly suited to applications requiring a high luminous intensity spot directly in front of the lighting component (e.g., when installed a light fixture 100 of FIG. 1), and lower luminous intensity peripheral lighting on opposing sides of the high luminous intensity spot (e.g., while mounted on a UTV). In accordance with the principles above, a beam pattern of a particular form may be specifically designed for a matching application, such that light is provided having a suitable target luminance for that application.

Figure 8:
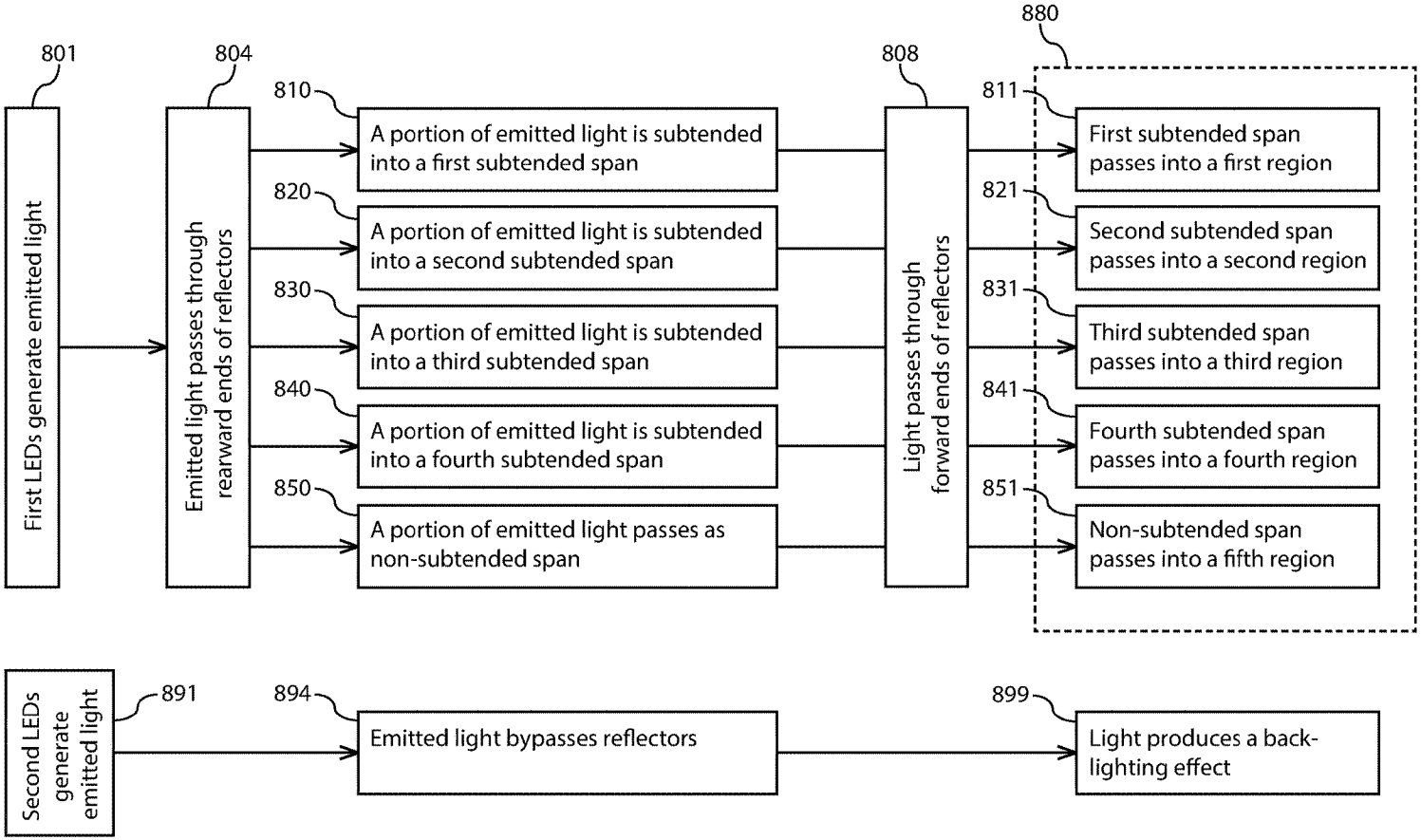
FIG. 8 illustrates a flow chart of a method for providing light forming a beam pattern with a target luminance.

FIG. 8 illustrates a flow chart of a method 800 for providing light forming a beam pattern with a target luminance. Light may be provided in accordance with a primary light mode of operation and/or in accordance with a back-lit mode of operation of a light fixture (e.g., light fixture 100 of FIG. 1). For example, a first mode of operation may include generation of light by one or more first LEDs. In another example, a second mode of operation may include generation of light by one or more second LEDs. In another example, a third mode of operation may include generation of light by the one or more first LEDs and the one or more second LEDs. Thus, a user of the light fixture may select any one or more of the above mode of operations. Further, any of the above modes of operation may be operable in an on state, an off state, and an intermittent state (e.g., strobing).

For example, one or more first LEDs may generate emitted light (e.g., as in 801) in response to flow of power therethrough. The emitted light may pass through corresponding rearward ends of one or more reflectors (e.g., as in 804). At least a portion of the emitted light may be subtended into a first subtended span by a first reflective surface extending from the rearward end to a forward end of the reflector (e.g., as in 810). At least a portion of the emitted light may be subtended into a second subtended span by a second reflective surface extending from the rearward end to the forward end (e.g., as in 820). At least a portion of the emitted light may be subtended into a third subtended span by a third reflective surface extending from the rearward end to the forward end (e.g., as in 830). At least a portion of the emitted light may be subtended into a fourth subtended span by a fourth reflective surface extending from the rearward end to the forward end (e.g., as in 840). At least a portion of the emitted light may pass through the one or more reflectors without interacting with any of the first, second, third, and fourth reflective surfaces, as a non-subtended span (e.g., as in 850). Further, the subtended and non-subtended spans may be passed through the forward end of the reflector (e.g., as in 808).

In another example, the first subtended span may pass into a first region with a first luminous intensity (e.g., as in 811), the second subtended span may pass into a second region with a second luminous intensity (e.g., as in 821), the third subtended span may pass into a third region with a third luminous intensity (e.g., as in 831), and the fourth subtended span may pass into a fourth region with a fourth luminous intensity (e.g., as in 841). Further, the non-subtended span may pass into a fifth region with a fifth luminous intensity (e.g., as in 851). Each of the first, second, third, fourth, and fifth regions may collectively form a beam pattern with a target luminance (e.g., as indicated by 880).

In another example, one or more second LEDs may generate emitted light (e.g., as in 891) in response to flow of power therethrough. The emitted light may pass beyond the one or more reflectors so as to bypass the reflective surfaces (e.g., as in 894). Further, the emitted light of the one or more second LEDs may produce a back-lighting effect within the light fixture (e.g., as in 899).

Other aspects and embodiments of the present invention will be apparent to those skilled in the art from consideration of the specification and practice of the invention disclosed herein. It is intended, therefore, that the specification and illustrated embodiments be considered as examples only, with a true scope and spirit of the invention being indicated by the following claims.

What is claimed is:

1. A lighting component, comprising:

a light source configured to emit light; and a reflector coupled in proximity to the light source and configured to receive the emitted light into a rearward end of the reflector and to provide the emitted light through a forward end of the reflector, the reflector consisting essentially of, a first reflective surface extending from the rearward end to the forward end, the first reflective surface configured to transform a portion of the emitted light into a first subtended span;

a second reflective surface extending from the rearward end to the forward end, the second reflective surface configured to transform a portion of the emitted light into a second subtended span;

a third reflective surface extending from the rearward end to the forward end, the second reflective surface configured to transform a portion of the emitted light into a third subtended span; and a fourth reflective surface extending from the rearward end to the forward end, the fourth reflective surface configured to transform a portion of the emitted light into a fourth subtended span.

2. The lighting component of claim 1, wherein the first reflective surface has a first focus, and the second reflective surface has a second focus different from the first focus.

3. The lighting component of claim 1, wherein the first subtended span forms focused light and the second subtended span forms collimated light.

4. The lighting component of claim 1, wherein the first and third subtended spans form focused light and the second and fourth subtended spans form collimated light.

5. A light fixture, comprising:

a PCBA coupled to a housing of the light fixture;

one or more first LEDs coupled to the PCBA and configured to emit light; and one or more reflectors coupled to the PCBA in proximity to the one or more first LEDs, respectively, the one or more reflectors configured to receive the emitted light into rearward ends of the one or more reflectors and to provide the emitted light through forward ends of the one or more reflectors, each of the one or more reflectors consisting essentially of, four reflective surfaces, each reflective surface extending from the rearward end to the forward end of each of the one or more reflectors, respectively.

6. The light fixture of claim 5, wherein the one or more reflectors includes three reflectors, and the one or more first LEDs includes at least three LEDs aligned with rearward ends of the one or more reflectors, respectively.

7. The light fixture of claim 5, wherein the four reflective surfaces of at least a first reflector of the one or more reflectors includes:

a first reflective surface configured to transform a portion of the emitted light into a first subtended span;

a second reflective surface configured to transform a portion of the emitted light into a second subtended span;

a third reflective surface configured to transform a portion of the emitted light into a third subtended span; and a fourth reflective surface configured to transform a portion of the emitted light into a fourth subtended span.

8. The light fixture of claim 7, wherein the first and third reflective surfaces have a common focus.

9. The light fixture of claim 7, wherein the first and third subtended spans form focused light and the second and fourth subtended spans form collimated light.

10. The light fixture of claim 5, further including:

one or more second LEDs coupled to the PCBA and configured to emit light beyond the one or more reflectors without being subtended thereby.

11. The light fixture of claim 10, wherein the one or more second LEDs are configured to emit light with a wavelength of between about 100 nanometers and about 1000 microns.

12. A method of emitting light from a light fixture, comprising:

emitting light from one or more first LEDs through a rearward end of a reflector;

subtending at least a portion of the emitted light into a first subtended span with a first reflective surface extending from the rearward end to a forward end of the reflector;

subtending at least a portion of the emitted light into a second subtended span with a second reflective surface extending from the rearward end to the forward end;

subtending at least a portion of the emitted light into a third subtended span with a third reflective surface extending from the rearward end to the forward end;

subtending at least a portion of the emitted light into a fourth subtended span with a fourth reflective surface extending from the rearward end to the forward end; and passing the first, second, third and fourth subtended spans through the forward end of the reflector.

13. The method of claim 12, wherein the first reflective surface causes the first subtended span to pass into a first region and the second reflective surface causes the second subtended span to pass into a second region different from the first region; and wherein the first and second subtended spans form a beam pattern having a target luminance.

14. The method of claim 12, wherein the first reflective surface causes the first subtended span to pass into a first region, the second reflective surface causes the second subtended span to pass into a second region, the third reflective surface causes the third subtended span to pass into a third region, and the fourth reflective surface causes the fourth subtended span to pass into a fourth region; and wherein the first, second, third, and fourth subtended spans form a beam pattern having a target luminance.

15. The method of claim 14, wherein the first and third regions are unique, and the second and fourth regions are substantially similar, such that the beam pattern includes a central high intensity portion and two opposing low intensity portions on either side of the high intensity portion.

16. The lighting component of claim 1, wherein the first and third reflective surfaces share a common focus.

17. The lighting component of claim 16, wherein the second and fourth reflective surfaces each have a focus different from the common focus.

18. The light fixture of claim 8, wherein the second and fourth reflective surfaces each have a focus different from the common focus.

19. The light fixture of claim 11, wherein the one or more second LEDs are configured to emit light having substantially one wavelength.

20. The method of claim 12, wherein the first and third reflective surfaces share a common focus, and the second and fourth reflective surfaces each have a focus different from the common focus.

* * * * *